US008292135B1

(12) United States Patent
Schorn

(10) Patent No.: US 8,292,135 B1
(45) Date of Patent: Oct. 23, 2012

(54) CLOTHES HANGAR ASSEMBLY, ADAPTATION APPARATUS, KIT AND HANGAR SO FORMED

(75) Inventor: James B. Schorn, Maple Grove, MN (US)

(73) Assignee: Schorn Enterprises, LLC, Maple Grove, MN (US)

( * ) Notice: Subject to any disclaimer, the term of this patent is extended or adjusted under 35 U.S.C. 154(b) by 0 days.

(21) Appl. No.: 12/973,137

(22) Filed: Dec. 20, 2010

Related U.S. Application Data

(60) Provisional application No. 61/288,009, filed on Dec. 18, 2009.

(51) Int. Cl.
*A41D 27/22* (2006.01)

(52) U.S. Cl. ..... 223/98

(58) Field of Classification Search ..... 223/85, 223/88, 92, 98
See application file for complete search history.

(56) References Cited

U.S. PATENT DOCUMENTS

| | | | | |
|---|---|---|---|---|
| 2,786,618 | A * | 3/1957 | Emmerling | 223/98 |
| 2,878,978 | A * | 3/1959 | Glowka | 223/98 |
| 2,910,215 | A * | 10/1959 | Auten | 223/98 |
| 3,733,016 | A * | 5/1973 | Rood | 223/98 |
| 6,138,880 | A * | 10/2000 | Williams | 223/98 |
| 7,124,920 | B2 * | 10/2006 | Gustafson et al. | 223/98 |
| 2006/0011672 | A1 * | 1/2006 | Veliuona et al. | 223/85 |
| 2006/0175363 | A1 * | 8/2006 | Cameron et al. | 223/85 |

* cited by examiner

*Primary Examiner* — Nathan Durham
(74) *Attorney, Agent, or Firm* — Nawrocki, Rooney & Sivertson, P.A.

(57) ABSTRACT

A kit characterized by elements for reversible securement to a clothes hangar for mitigating fabric distress upon hanging articles of clothing otherwise hung thereupon is generally provided. In kit format, the elements generally include first and second shoulder landing elements, each shoulder landing element of the first and second shoulder landing elements receivable upon each shoulder member of shoulder members of the clothes hangar, and a formable fold landing element for support upon a horizontal member of the clothes hangar.

1 Claim, 14 Drawing Sheets

CLOTHES HANGAR ASSEMBLY, ADAPTATION APPARATUS, KIT AND HANGAR SO FORMED

This is a regular utility application filed under 35 U.S.C. §111(a) claiming priority under 35 U.S.C. §119(e)(1), of provisional patent application Ser. No. 61/288,009, filed Dec. 18, 2009, and entitled "Clothes Hanging Apparatus," said application incorporated herein by reference in its entirety.

TECHNICAL FIELD

The subject invention is generally directed to an improved clothes hanging assembly or apparatus, more particularly, to a clothes hanging apparatus that prevents wrinkling and/or eliminates localized visually unappealing fabric distress for clothing articles so hung, and more particularly still, to a clothes hangar adaptation apparatus, advantageously in kit form, for enhancing the performance of a conventional hangar via an improved receipt of articles of clothing so hung via adaptation of the hangar via apparatus elements.

BACKGROUND OF THE INVENTION

After the removal of tops such as shirts, blouses, sweaters, etc. from a washing machine, such items are advantageously laid flat to dry, the notion being that no stress is being imparted to the fabric of the top, and shape is retained. Contrariwise, when tops are hung on conventional hangers for drying, or thereafter for hung storage in a closet, the end result leaves annoying pucker or puff marks in the shoulder areas, requiring the time and inconvenience of ironing, or re-ironing, to insure a neat appearance.

Furthermore, when trousers, slacks, etc. are likewise hung so as to be fold over a portion of a conventional hanger for a period of time, or as delivered after dry-cleaning, wrinkling, more particularly, crease marks, are imparted to the fabric of the material, further requiring additional time and the inconvenience of re-ironing or pressing. Thus, there remains an unmet need to provide a clothes hanging apparatus which provides an enhanced taper, and/or increased surface area to relieve fabric stress/stretch in shoulder areas from tops, as well as wrinkling and/or hanger marks for trousers and the like. Advantageously, but not necessarily, conventional hangers may be readily adapted to provide the sought after functionality or performance via "snap-on" apparatus elements, kit structures, or the like.

SUMMARY OF THE INVENTION

A kit characterized by elements for reversible securement to a clothes hangar for mitigating fabric distress upon hanging articles of clothing otherwise hung thereupon is generally provided, as is such hangar apparatus so assembled, or such assembly more generally. In kit format, the elements generally include first and second shoulder landing elements, each shoulder landing element of the first and second shoulder landing elements receivable upon each shoulder member of shoulder members of the clothes hangar, and a formable fold landing element for support upon a horizontal member of the clothes hangar.

Each shoulder landing element of the first and second shoulder landing elements include opposing first and second end portions, an arcuate fabric receiving surface, and a plurality of hangar engaging elements. The second end portion includes a rounded terminal free end which defines a clothing contact transition point for the shoulder landing element whereupon the clothing freely hangs distally thereof. The arcuate fabric receiving surface increasingly tapers in width from the first end portion to the second end portion. Each hangar engaging element of the hangar elements are tensioningly receivable upon a segment of the shoulder member of the clothes hangar for securing the shoulder landing element thereto while nonetheless permitting a selective, reversible sliding of the shoulder landing element upon the shoulder member of the clothes hangar so as to selectively position the rounded terminal free end of said second end portion of the shoulder landing element in a spaced apart relationship with regard to a hook of the clothes hangar.

The formable fold landing element includes first and second fold landing element portions unitable in furtherance of spanning a substantial portion of the horizontal member of the clothes hangar. Each fold landing element portion of the first and second fold landing element portions includes opposing first and second ends, an arcuate fabric engaging surface adapted to mitigate fabric slippage thereupon, and at least two hangar engaging elements.

The first end of the first and second ends includes an adaptation to permit reversible union of the first and second fold landing element portions, the second end of the first and second ends including a notched free end. The arcuate fabric engaging surface includes a slot which extends from a notch of the second end of the first and second ends of the fold landing element portion. Each hangar engaging element of the at least two hangar elements are tensioningly receivable upon a segment of the horizontal member of the clothes hangar for securing the fold landing element portions thereto.

DETAILED DESCRIPTION OF THE FIGURES/DEPICTIONS

Figure 1:
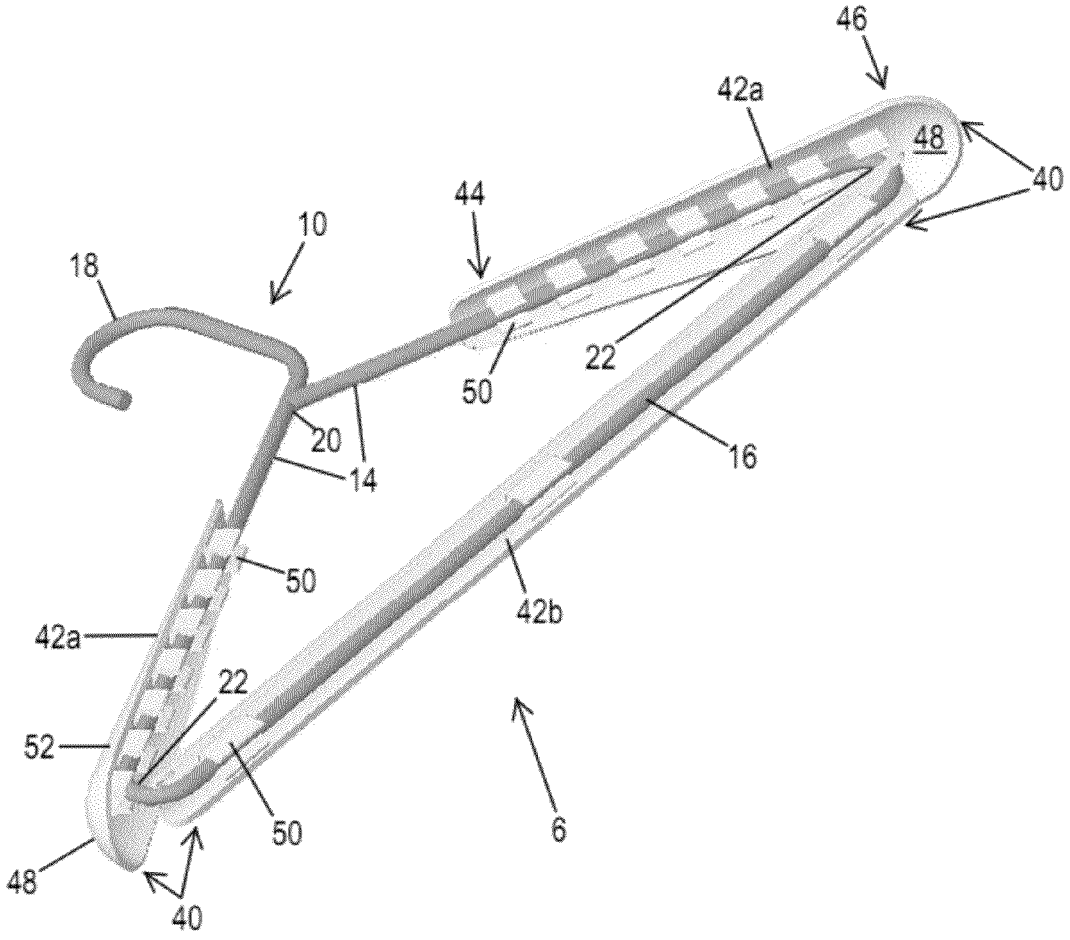
FIGS. 1-3 depict a clothes hanging assembly, in several views, more particularly, and advantageously, a conventional clothes hangar equipped with a elements of an apparatus of the subject invention, namely, a plurality of fabric receiving elements.
Figure 2:
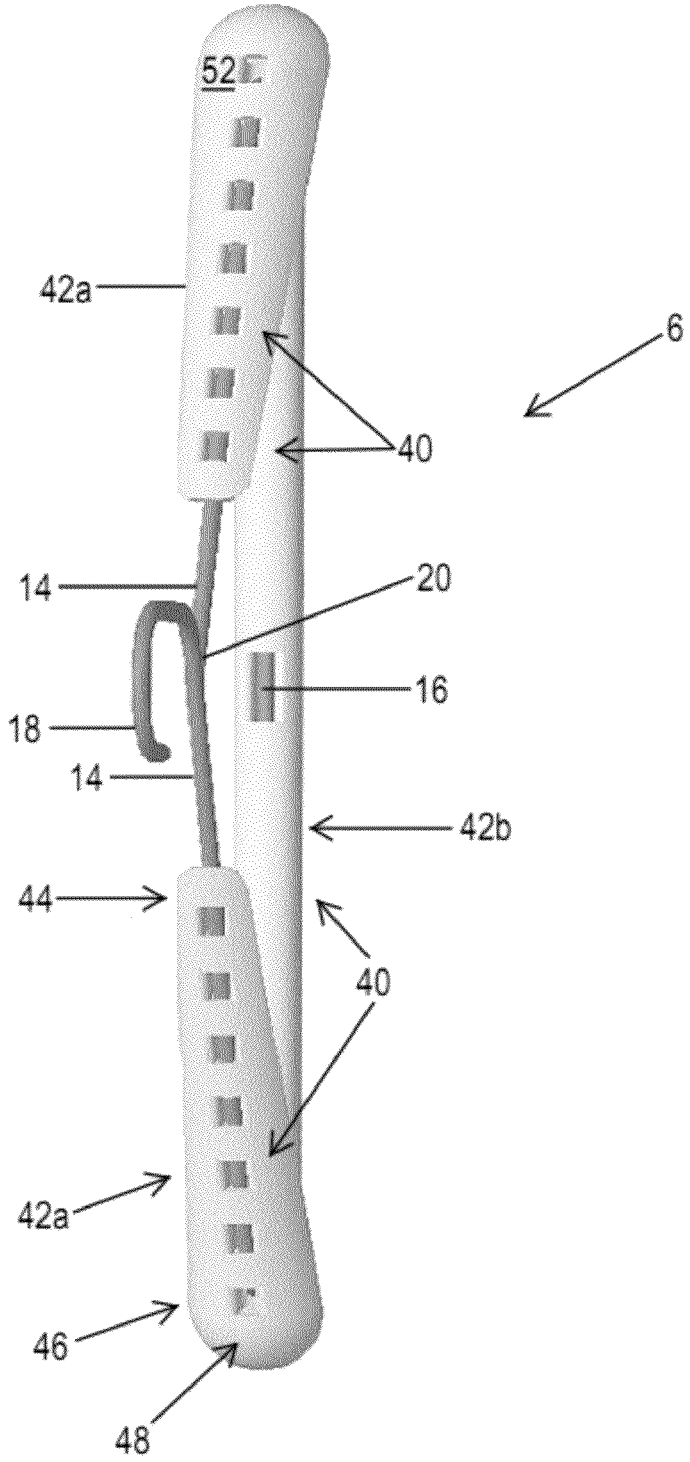
Figure 3:
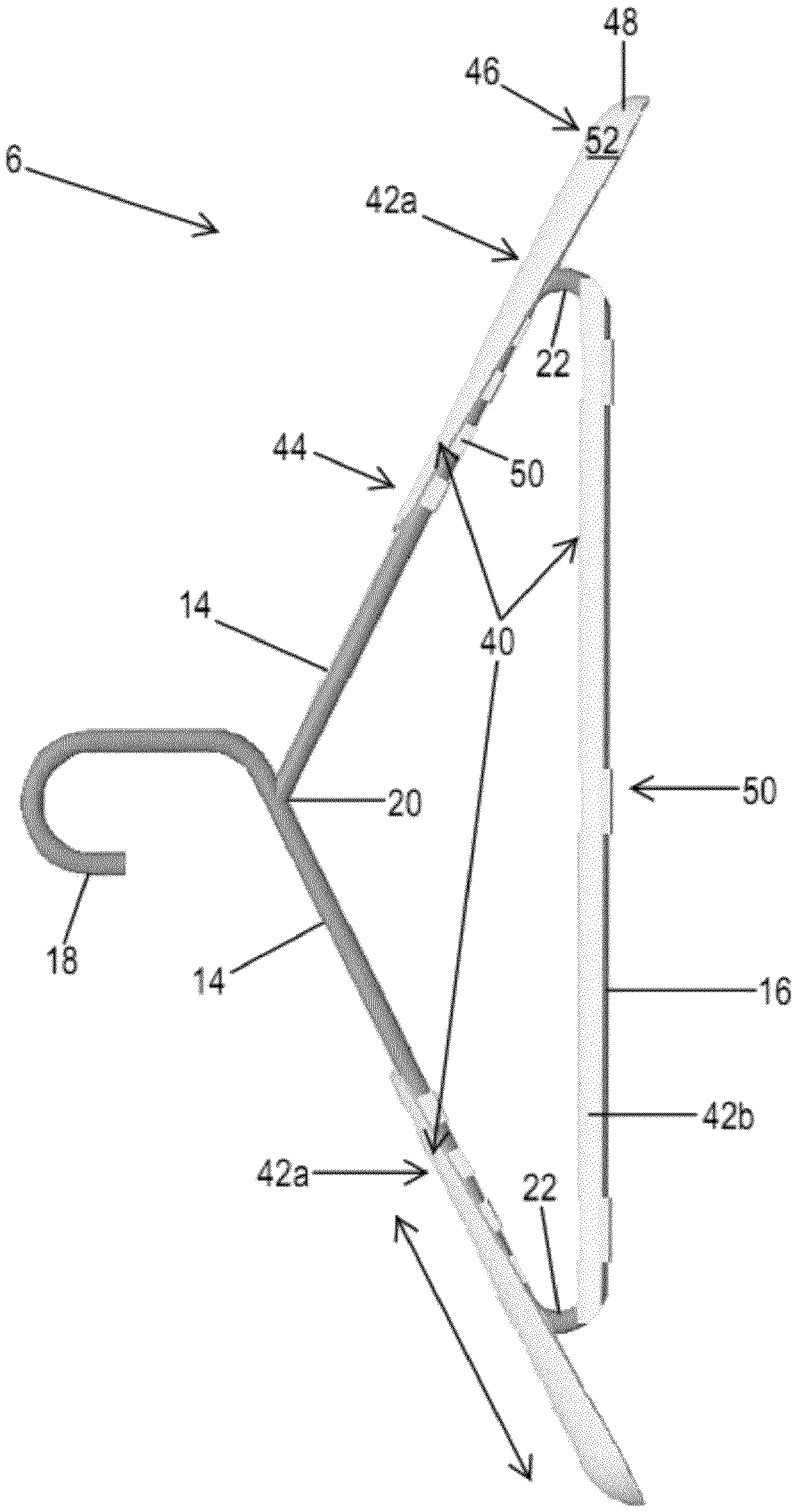

With reference now to FIGS. 1-3, a hangar assembly 6 is depicted, more particularly, a conventional hanger 10 is shown equipped with a plurality of fabric receiving elements 42. Although a premise of the subject invention is to outfit conventional clothes hangers with the elements illustrated, it should be readily appreciated that a clothes hanging apparatus otherwise incorporating the form and function of the elements is likewise contemplated.

As shown, a conventional hanger 10, more particularly, a dual use hanger for hanging support of a pair of trousers or the like, and/or a shirt, etc. is shown in an adapted state or condition via operative support of elements of a preferred, non-limiting apparatus 40 of the subject invention. The hanger 10 generally comprises a plurality of arms, namely paired shoulder members 14 united by a horizontal member 16, and a support or suspension element such as a hook 18 upwardly extending from the union or intersection 20 of the shoulder members 14. Although not illustrated, such conventional hangars may further include a brace, either in the form of a webbing which "fills" hangar crotch 22, or member which links shoulder members 14 to horizontal member 16 in the vicinity of crotch 22.

The apparatus 40, advantageously supplied in a kit format, generally includes a plurality of clothing/fabric receiving elements 42 supported or supportable by hanger 10. Apparatus 40 advantageously include shoulder landing elements or wings 42*a*, receivable and selectively positionable upon the shoulder members 14 of the hanger 10, and a fold landing 42*b* supported by the horizontal member 16 of the hanger 10.

With regard to the wings 42*a*, they are generally tapered so as to have an expanding width in a direction distal from the hook 18 as shown (i.e., from a first end portion 44, positioned so as to be adjacent the hangar hook, to a second end portion 46 thereof). Advantageously, the wings 42*a* have an arcuate cross section, with the second end portion including a rounded terminal free end 48. Integral to each wing 42*a* are a plurality of hanger receiving retainers, more particularly, spaced apart spring clips 50 or the like (see also, e.g., FIG. 4C), which permit integration of the wings to the conventional hanger, e.g., as by pressing or pressing/sliding engagement with the shoulder members 14 of the hanger 10 (note sliding of FIG. 3 indicated via the two headed arrow (↔)).

As should be readily appreciated in connection to FIG. 3, advantageously, but not necessarily, provisions and placement of plural linkages permit translation of the wing upon the shoulder member so as to accommodate a variety of differing "shoulder" dimensioned articles while maintaining a sufficient supporting interface with the hangar. Moreover, as indicated via cross-out (X) with reference to FIG. 2 (and also 4A), less than the depicted number of retainers 50 may be required to accomplish the sought after interface and adjustment functionality, the retention of such structures in the 1, 3, 5 & 6 positions, from first end portion 44 to second end portion 46, are believed especially advantageous.

Fold receiving element or landing 42*b*, which is generally, but not necessarily, dimensioned to traverse the width of the horizontal hanger member 16, has an arcuate cross section and sufficient surface area to prevent imparting stress to fabric folded thereover. The landing 42*b* likewise includes at least two retainers, e.g., spring clips 50 or the like, to engage and maintain an interference fit with the horizontal element 16 of the hanger 10.

Figure 4:
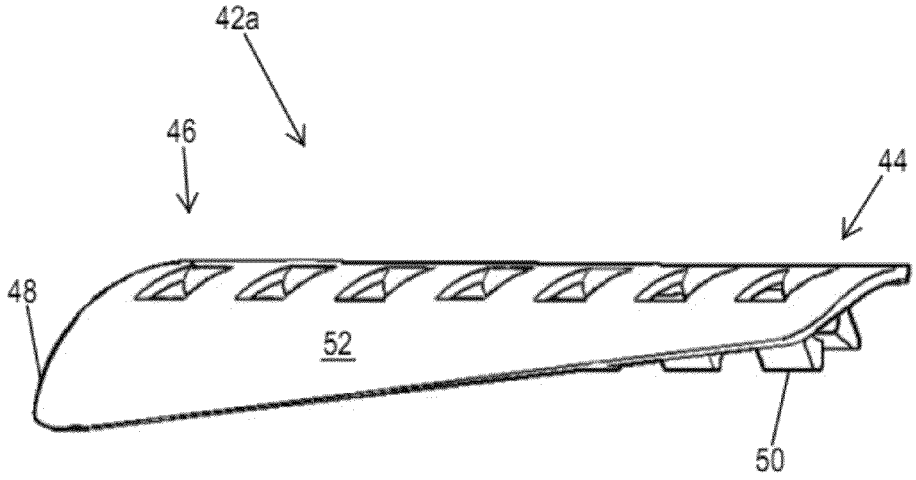
FIGS. 4-4D depict preferred, non-limiting shoulder landing elements of the hangar assembly of FIGS. 1-3, more particularly, as viewed slightly from above (FIG. 4), from above in plan (FIG. 4A), from the side/in side elevation (FIG. 4B), from below in plan (FIG. 4C), and as viewed from slightly below along a length thereof; and, FIGS. 5-5E' depict preferred, non-limiting members of paired fold receiving members of the hangar assembly of FIGS. 1-3, more particularly, as viewed slightly from above, free end to the right (FIG. 5), from the side/in side elevation, free end to the right (FIG. 5A), from above in plan, free end to the right (FIG. 5B), from the end, more particularly, a free end elevation (FIG. 5C), from another end, more particularly, an interlocking/interface end elevation (FIG. 5D), and from below in plan (FIG. 5E), with an alternate free end configuration provided (FIG. 5E').
Figure 4A:
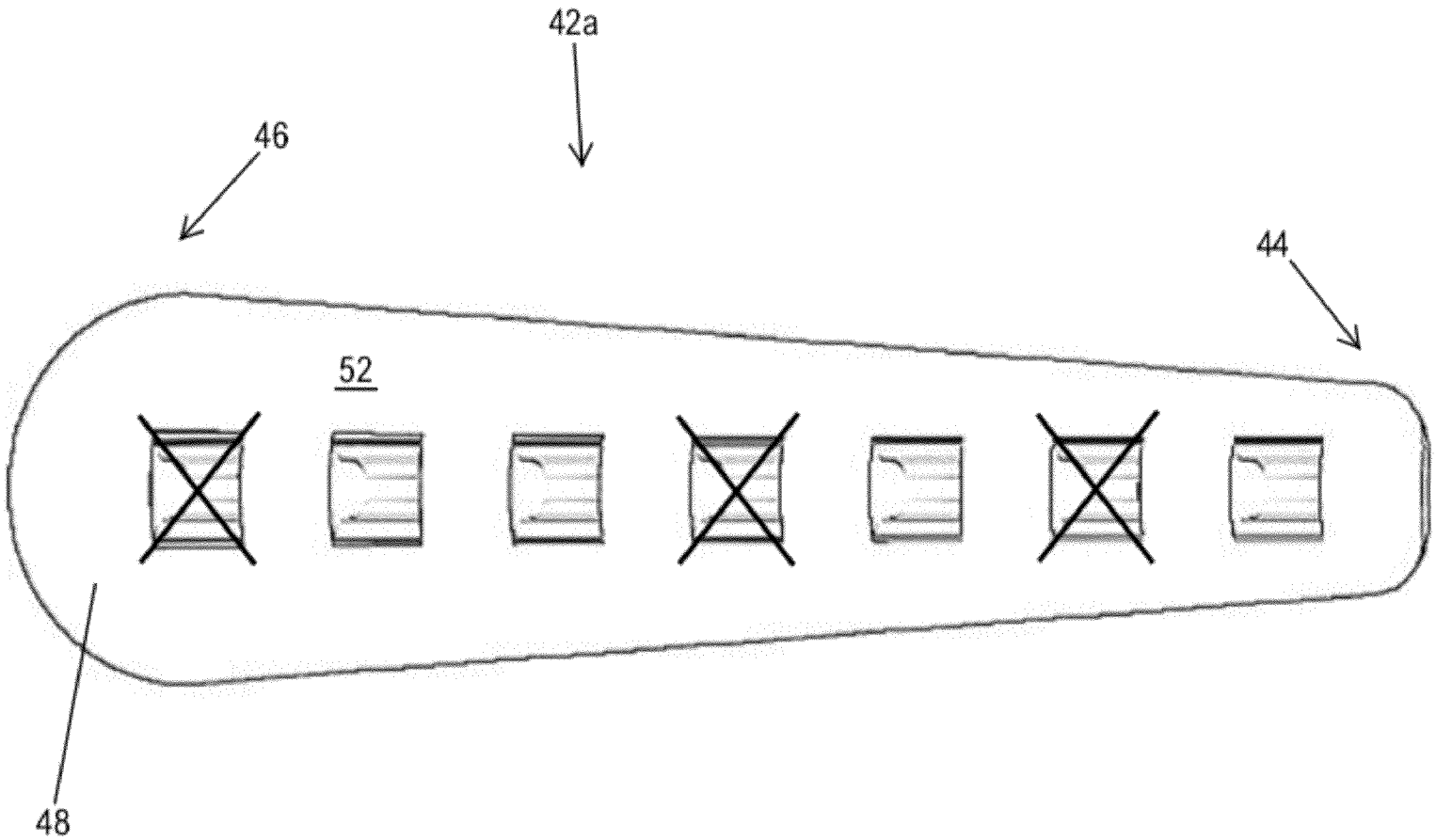
Figure 4B:
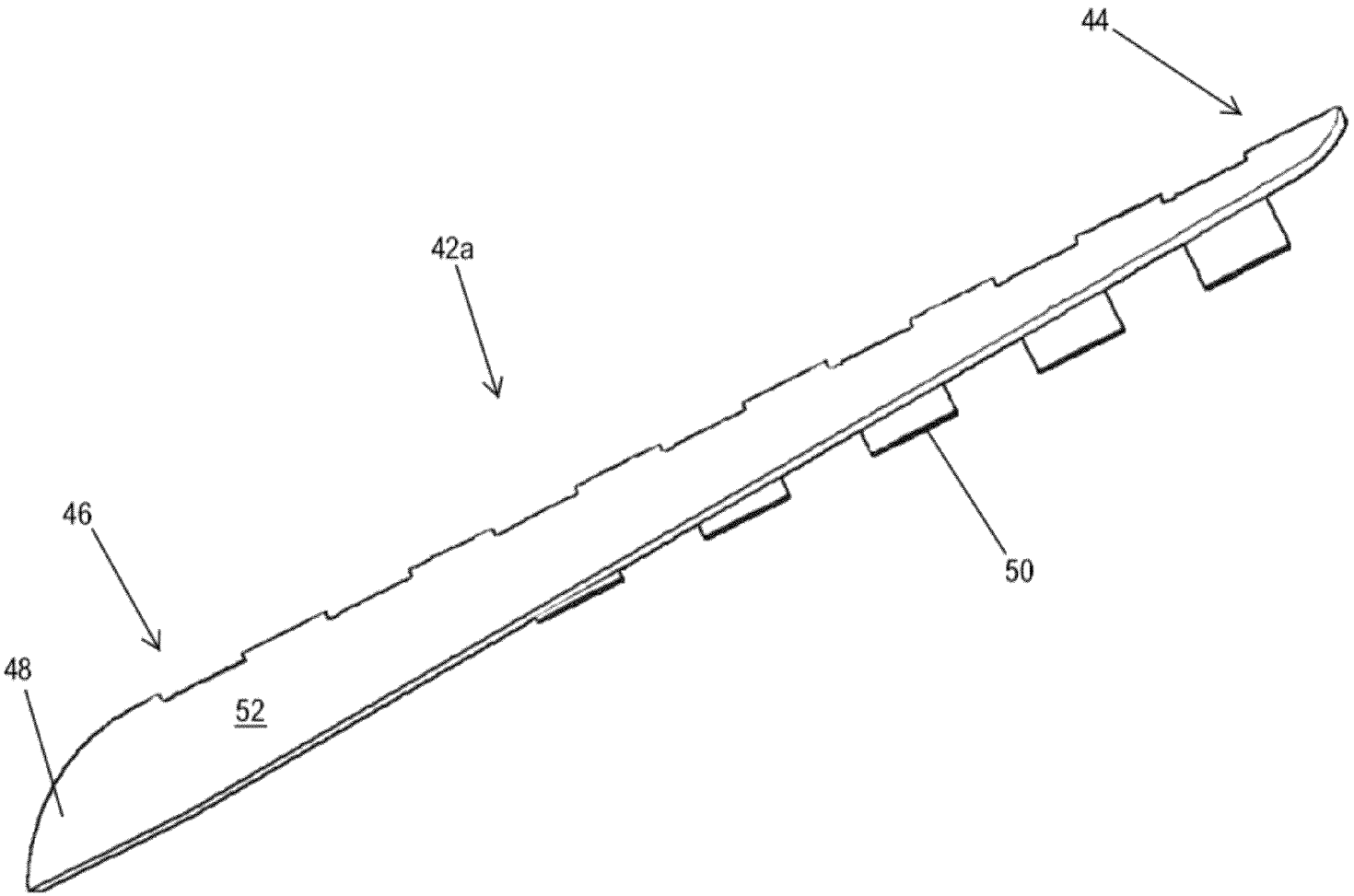
Figure 4C:
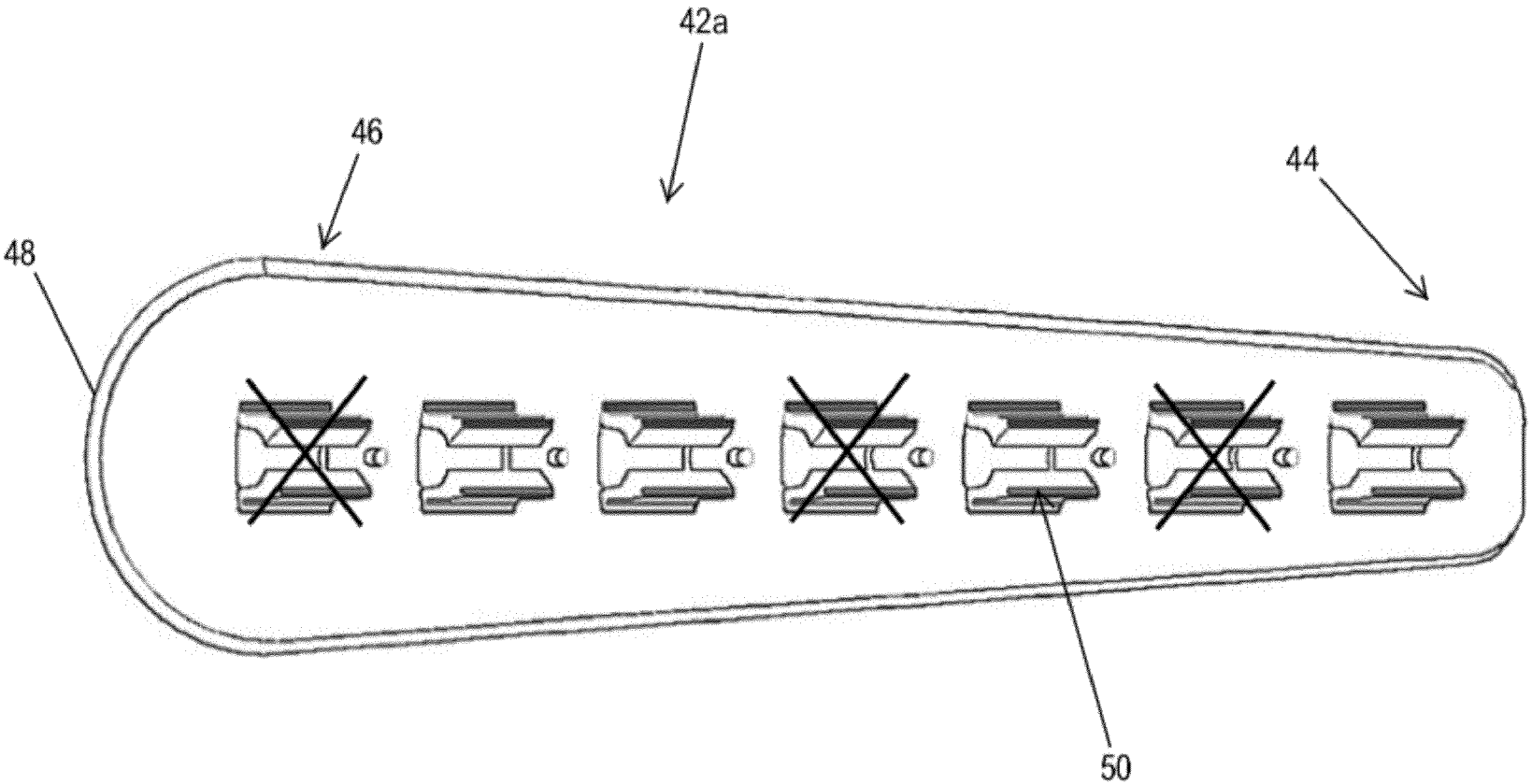
Figure 4D:
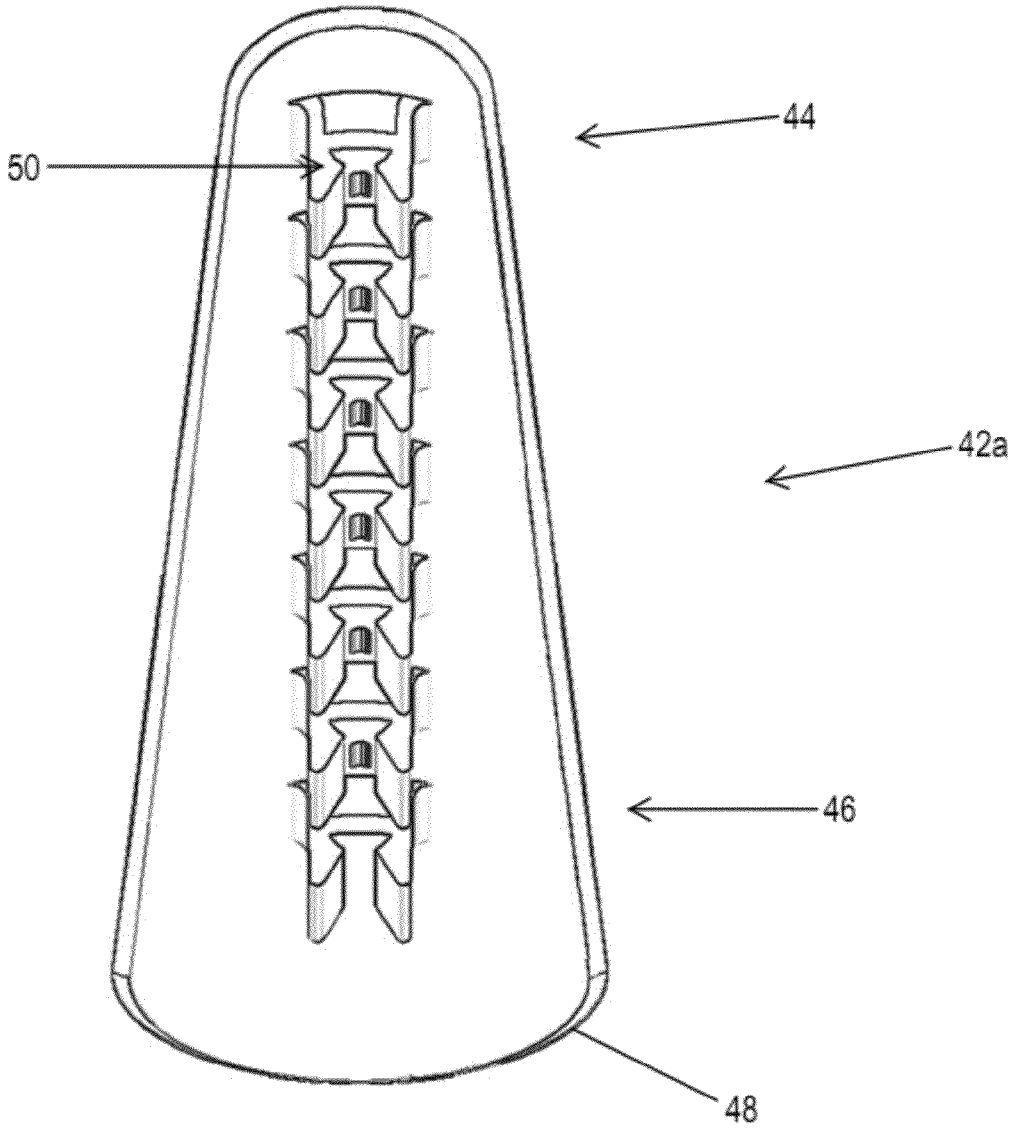
Figure 5:
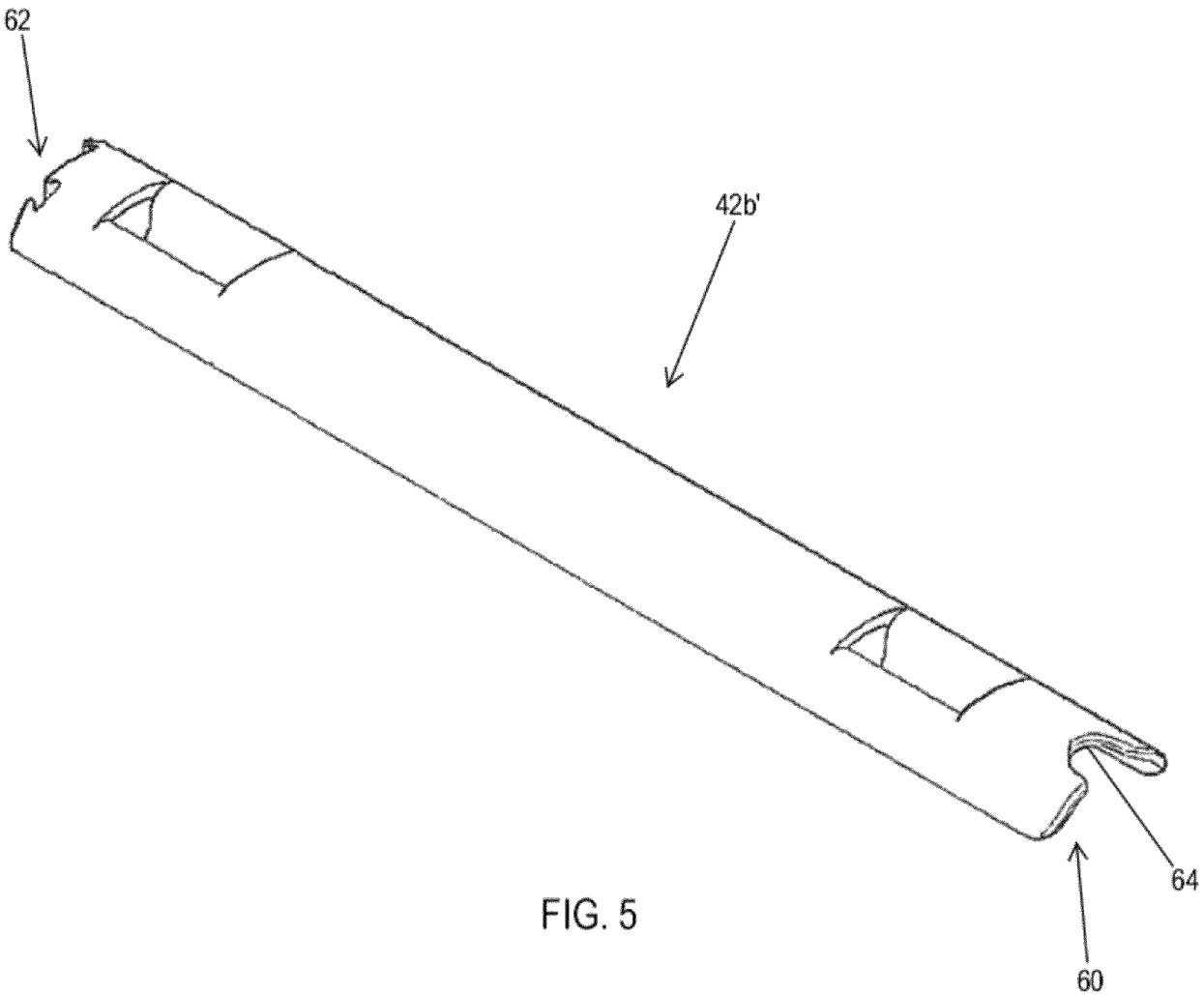

Turning now to FIGS. 4 & 5, advantageous, non-limiting apparatus elements are depicted. With reference to FIGS. 4-4D, several views of a shoulder landing element are provided. As noted in connection to FIGS. 1-3, characteristic of the shoulder landing element is a taper (i.e., reduced or reducing width dimension throughout its length; FIG. 4A) intended to orient, align or extend in a direction toward a hook of the hangar (FIG. 2) (i.e., from the second end portion 46 thereof to the first end portion 44 thereof), an arcuate fabric receiving surface 52 (e.g., FIGS. 4, 4B/4C), and engagement means (e.g., retainers 50, FIGS. 4C & 4D) for reversibly and selectively affixing the structure to shoulder members of a hangar. As previously noted, a more extensive engagement means is believed advantageous as the shoulder landing element may be easily and readily slid upon the shoulder member so as to have its more expansive end portion extend beyond/off the member in furtherance of supporting a relatively "oversized" shoulder portion of a garment while nonetheless maintaining a sure engagement with less than the entirety of the engagement means operatively engaged.

Structurally, the shoulder landing element of the subject apparatus is intended to substantially correspond in length to/with the shoulder member of the hangar. For example, for a conventional hanger having a shoulder member of about 9-9.5 inches, the shoulder landing element of the subject apparatus longitudinally extends to a length of about 8.25 inches, with a practical operable/functional range being within about 6-9 inches. As to the taper, it is believed that a taper within a range of about 1.5-2.5 is practicable, with 2 believed advantageous, the first free end 44 portion having an advantageous, non-limiting lateral maximum extent of about 1 inch (FIG. 4A or 4C, figure right), the second free end 46 portion having an advantageous, non-limiting lateral maximum extent of about 2 inches (FIG. 4A or 4C, figure left). With regard to the rounded terminal free end 48 of the second free end portion 46 of the shoulder landing element, a radius of about 1 inch is believed advantageous. With regard to the arcuate surface fabric or clothing article receiving surface, it is generally delimited by a height or thickness, see e.g., FIG. 4B, of the first free end portion 44 of the shoulder landing element of about 0.25 inches and a height or thickness, see e.g., FIG. 4B, of the second free end portion of the shoulder landing element of about 0.5 inches. Finally in connection to the retainers, a preferred non-limiting spacing or location for those indicated at FIG. 4A is generally at about 1, 3, 5 and 6 inches with reference to a terminal end of the first free end portion 44 of the shoulder landing element.

Figure 5A:
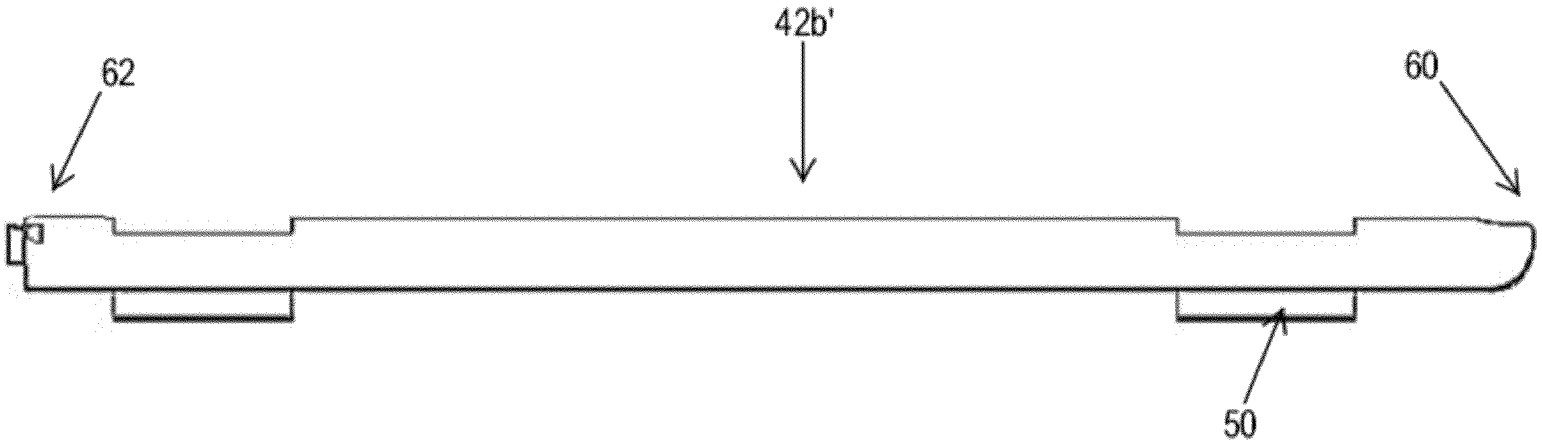
Figure 5B:
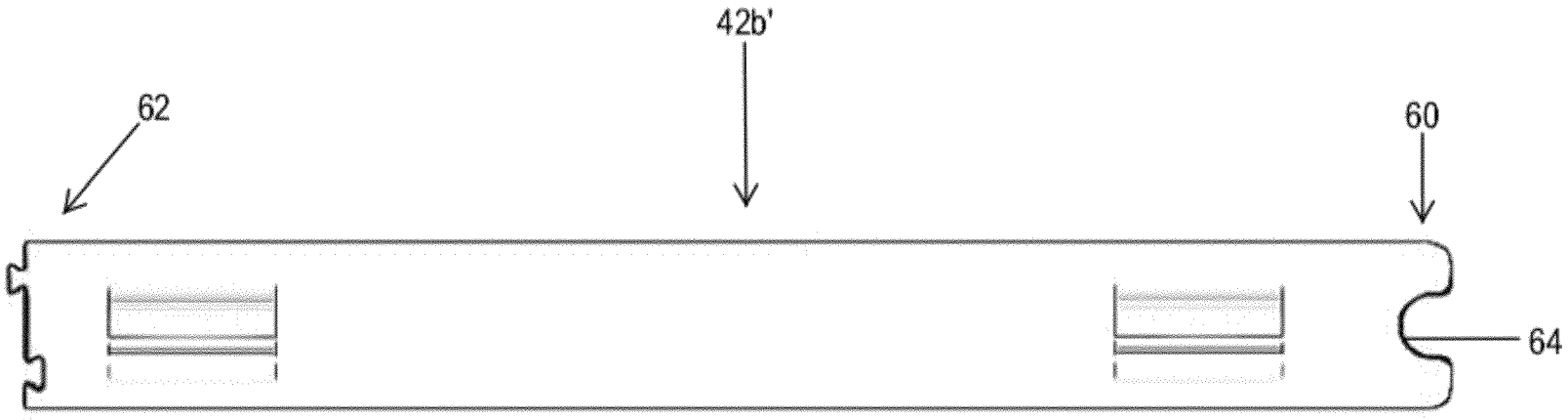
Figure 5C:
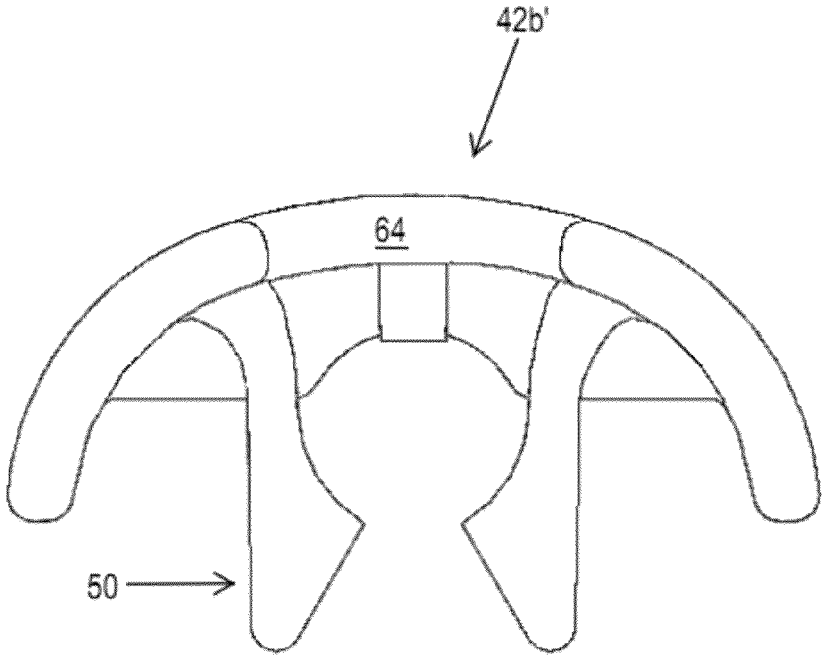
Figure 5D:
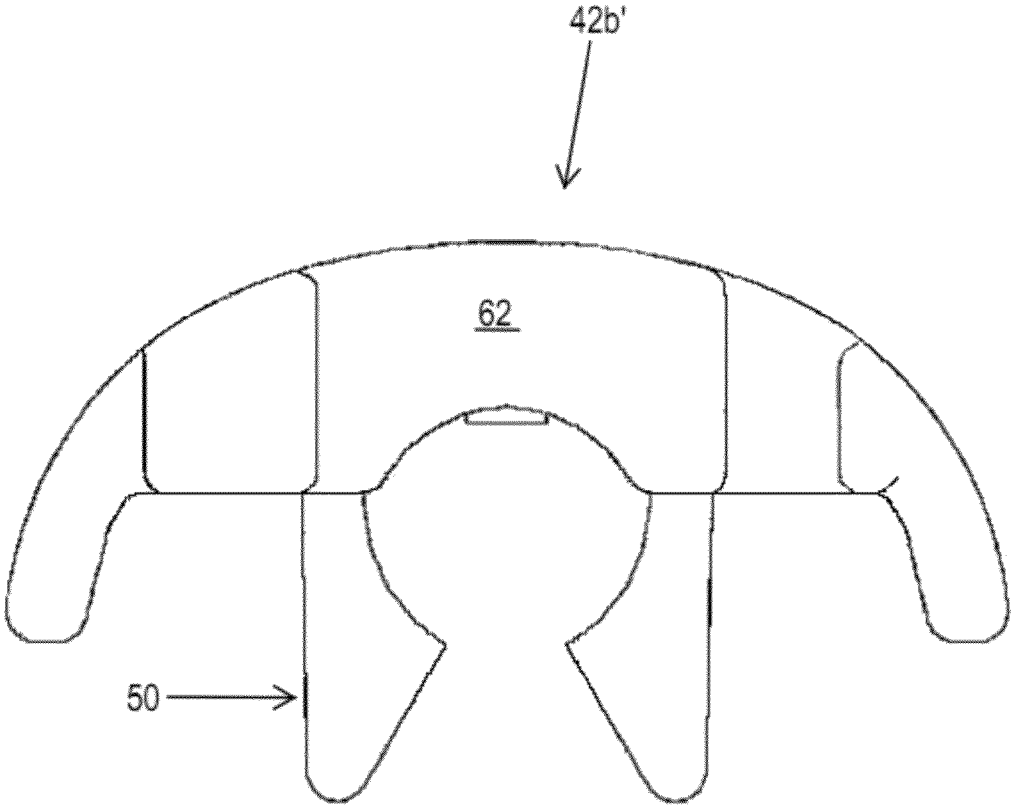
Figure 5E:
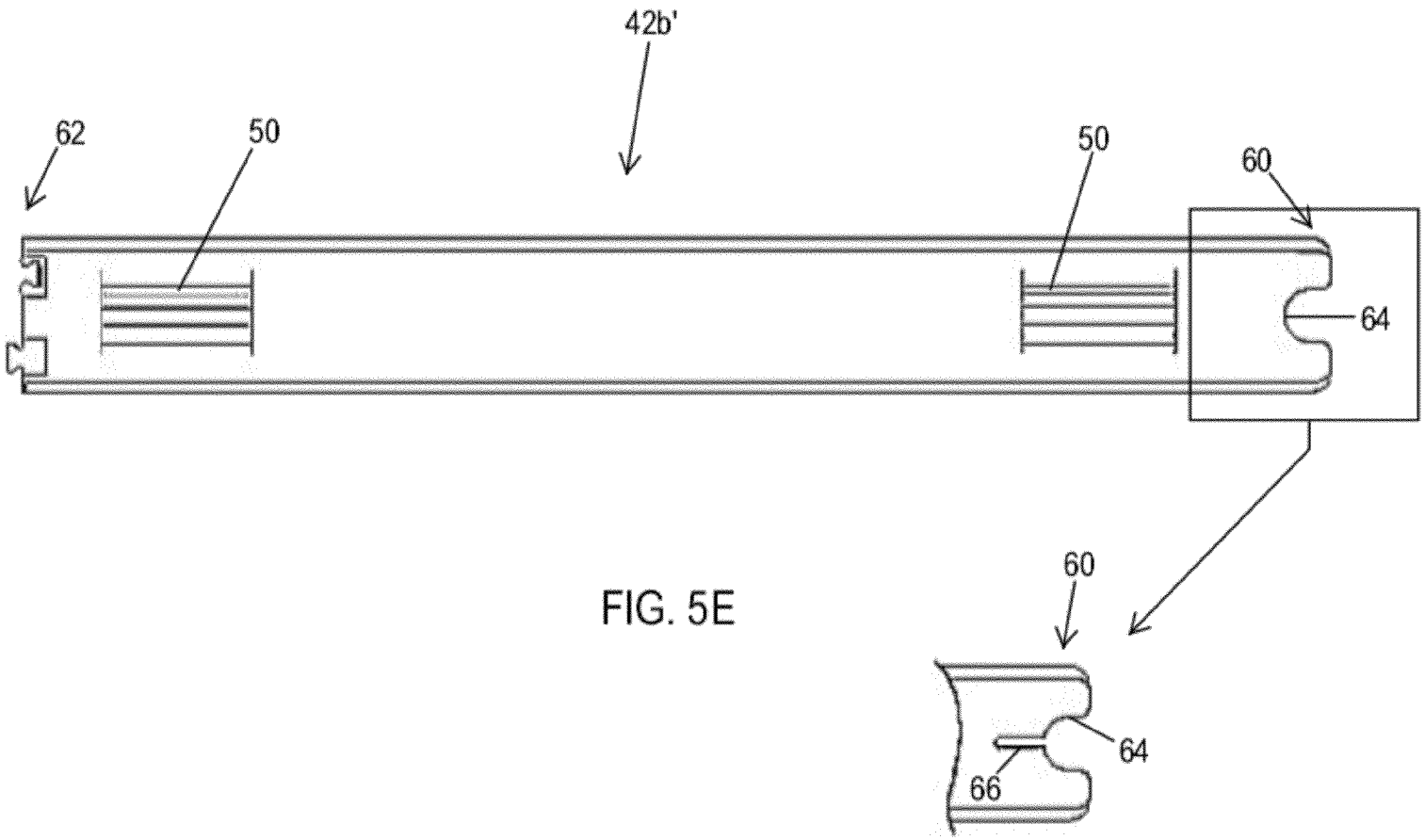

With reference to FIGS. 5-5E', a portion 42*b*' of paired member portions corresponding to the horizontal hangar member 42*b* is depicted and advantageously provided for with regard to the subject apparatus or kit. As best seen in connection to FIG. 5B, the fold receiving landing portion 42*b*' is advantageously characterized by opposing ends, more particularly a free end 60 and an adapted end 62. The adapted end is characterized by or comprises interlocking means, for example, and without limitation, a ying and yang profile, e.g, as shown, male and female dovetail configurations. The free end preferably, but not necessarily, includes a notch 64 intended to receive the crotch or bend characteristic of the hangar transition between the shoulder and horizontal member. End particulars are best viewed in connection to the end elevation views of FIGS. 5C & 5D for the free end 60 and interlocking end 62 respectively, with hangar engagement means likewise depicted, see also FIGS. 5A & 5E. Moreover, as indicated in FIG. 5E', a further alternate configuration for the free or crotch end 60 of the fold receiving landing portion 42*b*', more particularly, an adaptation of the end of FIG. 5E wherein a slot 62 extends from notch 64 so as to accommodate conventional hangars characterized by the previously noted reinforcement element/structure for and between the shoulder members and the horizontal member in the vicinity of the crotch.

Structurally, the fold landing element of the subject apparatus is intended to substantially correspond in length to/with the horizontal member of the hangar. For example, for a conventional hanger having a horizontal member of about 15-16 inches, each member of the paired member portions of fold receiving element longitudinally extend to a length of about 8.5 inches, with a practical operable/functional range being within a range of about 7.5-9 inches. With reference to, e.g., FIG. 5C, a exemplary, advantageous width or lateral extent is about 1 inch, with a height of about 0.75 inches delimiting an arcuate fold receiving surface thereof.

Advantageously, but not necessarily, the described and depicted elements, including variants thereof, are fabrication from widely available commercial plastics. Moreover, while the shoulder landing elements are advantageously intended to offer little resistance to fabric movement or flow, the fold landing element is preferably intended offer resistance to fabric movement or flow. For instance, and without limitation, the fabric engaging surface thereof may include a texturing or the like, or the entire element may be fabricated from material offering such resistance.

Be that as it may, there are nonetheless other variations of the subject invention, some of which will become obvious to those skilled in the art. It is to be understood that this disclosure, in many respects, is only illustrative. Changes may be made in details, particularly in matters of shape, size, material, and arrangement of parts, as the case may be, without exceeding the scope of the invention. Moreover, it is to be appreciated that the disclosed/depicted elements may be readily scaled and/or adapted by those of ordinary skill in such arts in furtherance of equipping a variety of "conventional" hangars with the elements referred to herein, or, modified and manufactured as a hangar or hangar assembly per se. Accordingly, the scope of the subject invention is as defined in the language of the appended claims.

That which is claimed:

1. A kit characterized by elements for reversible securement to a clothes hangar for mitigating fabric distress upon hanging articles of clothing otherwise hung thereupon, said elements of the kit comprising:

a. first and second shoulder landing elements, each shoulder landing element of said first and second shoulder landing elements receivable upon each shoulder member of shoulder members of the clothes hangar, each shoulder landing element of said first and second shoulder landing elements comprising:

i. opposing first and second end portions, said second end portion including a rounded terminal free end which defines a clothing contact transition point for said shoulder landing element whereupon the clothing freely hangs distally thereof;

ii. an arcuate fabric receiving surface which increasingly tapers in width from said first end portion to said second end portion; and, iii. a plurality of hangar engaging elements, each hangar engaging element of said hangar elements being tensioningly receivable upon a segment of the shoulder member of the clothes hangar for securing said shoulder landing element thereto while nonetheless permitting a selective, reversible sliding of said shoulder landing element upon the shoulder member of the clothes hangar so as to selectively position said rounded terminal free end of said second end portion of said shoulder landing element in a spaced apart relationship with regard to a hook of the clothes hangar; and, b. a formable fold landing element for support upon a horizontal member of the clothes hangar, said formable fold landing element comprising first and second fold landing element portions unitable in furtherance of spanning a substantial portion of the horizontal member of the clothes hangar, each fold landing element portion of said first and second fold landing element portions comprising:

i. opposing first and second ends, said first end of said first and second ends including an adaptation to permit reversible union of said first and second fold landing element portions, said second end of said first and second ends including a notched free end;

ii. an arcuate fabric engaging surface adapted to mitigate fabric slippage thereupon, said arcuate fabric engaging surface including a slot, said slot extending from said notch of said second end of said first and second ends of said fold landing element portion; and, iii. at least two hangar engaging elements, each hangar engaging element of said at least two hangar elements being tensioningly receivable upon a segment of the horizontal member of the clothes hangar for securing said fold landing element portions thereto.

* * * * *